US005182821A

United States Patent [19]

Bufford et al.

[11] Patent Number: 5,182,821

[45] Date of Patent: Feb. 2, 1993

[54] PANEL CONSTRUCTION FOR BATHING TUB

[75] Inventors: Charles D. Bufford, Blue Hill; James M. Gruidel, Hastings, both of Nebr.

[73] Assignee: Dutton-Lainson Company, Hastings, Nebr.

[21] Appl. No.: 765,364

[22] Filed: Sep. 24, 1991

[51] Int. Cl.[5] ..... A47K 3/16

[52] U.S. Cl. ..... 4/592; 4/595

[58] Field of Search ..... 4/584, 589, 592, 593, 4/595, 585, 506

[56] References Cited

U.S. PATENT DOCUMENTS

| | | | |
|---|---|---|---|
| 1,633,685 | 6/1927 | Stark | 4/584 |
| 2,117,233 | 5/1938 | Clark | 4/592 |
| 3,028,603 | 4/1962 | Rodman | 4/584 |
| 4,290,154 | 9/1981 | Benjamin | 4/584 |
| 4,691,392 | 9/1987 | Whitney | 4/595 |
| 4,879,858 | 11/1989 | Murdoch | 4/595 |
| 4,974,266 | 12/1990 | Vultaggio et al. | 4/506 |

FOREIGN PATENT DOCUMENTS

| | | | |
|---|---|---|---|
| 3525187 | 1/1987 | Fed. Rep. of Germany | 4/584 |
| 1339294 | 12/1965 | France | 4/595 |
| 2603314 | 3/1988 | France | 4/584 |
| 440610 | 12/1967 | Switzerland | 4/595 |
| 586748 | 3/1947 | United Kingdom | 4/595 |

*Primary Examiner*—Charles E. Phillips
*Attorney, Agent, or Firm*—Allegretti & Witcoff

[57] ABSTRACT

An improved bathing tub construction includes a support frame, a molded tub enclosure cooperative with the frame and retained on the frame by means of a rigid tub assembly member which is constructed to cooperate with removable vertical panels and also with a flexible trim member to provide aesthetic and safety coverage of the seams defining the tub construction.

2 Claims, 2 Drawing Sheets

PANEL CONSTRUCTION FOR BATHING TUB

BACKGROUND OF THE INVENTION

This invention relates to an improved tub enclosure construction and more particularly to a tub construction comprised of a frame, a premolded, relatively thin walled tub enclosure cooperative with the frame and vertical side wall panels further cooperative with the frame.

Tub enclosures, in particular hospital tub enclosures, include, in addition to the normal plumbing fixtures, a variety of additional piping, motors and other apparatus within the framework of the tub assembly for the purpose of providing therapeutic flow of bath water and fluids, temperature control and other desireable characteristics associated with a bathing construction. It thus becomes desirable to provide a tub enclosure assembly which is easily disassembled for repair and access to the internal working mechanism associated with the system.

SUMMARY OF THE INVENTION

Briefly, the present invention comprises an improved bathing tub construction which includes a support frame, a molded, generally thin walled tub enclosure supported on the frame to define a bathing enclosure, vertical side panels and a special rigid tub assembly member which cooperatively engages the frame, the tub enclosure and the vertical side panels and which further cooperates with a flexible trim member that is insertable therein to cover the assembly seams. In this manner, the assembly not only is appealing aesthetically but also is enhanced from the safety viewpoint because of all of the seams are generally inaccessible except upon removal of the trim member. Further, the vertical panels of the assembly or construction are easily removed for access for servicing and repair.

Thus, it is an object of the invention to provide an improved bathing tub construction.

It is a further object of the invention to provide an improved bathing tub construction which utilizes an unique rigid tub assembly member in combination with a frame, a tub enclosure and vertical side members as well as a trim member.

Yet another object of the invention is to provide an improved tub construction which may be easily assembled and disassembled for service, repair and replacement.

Yet a further object of the invention is to provide an improved tub construction which is aesthetically pleasing, is highly serviceable, easy to maintain, and is economical to manufacture and service.

These and other objects, advantages and features of the invention will be set forth in the detailed description that follows.

BRIEF DESCRIPTION OF THE DRAWING

In the detailed description that follows, reference will be made to the drawing comprised of the following Figures.

DESCRIPTION OF THE PREFERRED EMBODIMENT

Figure 1:
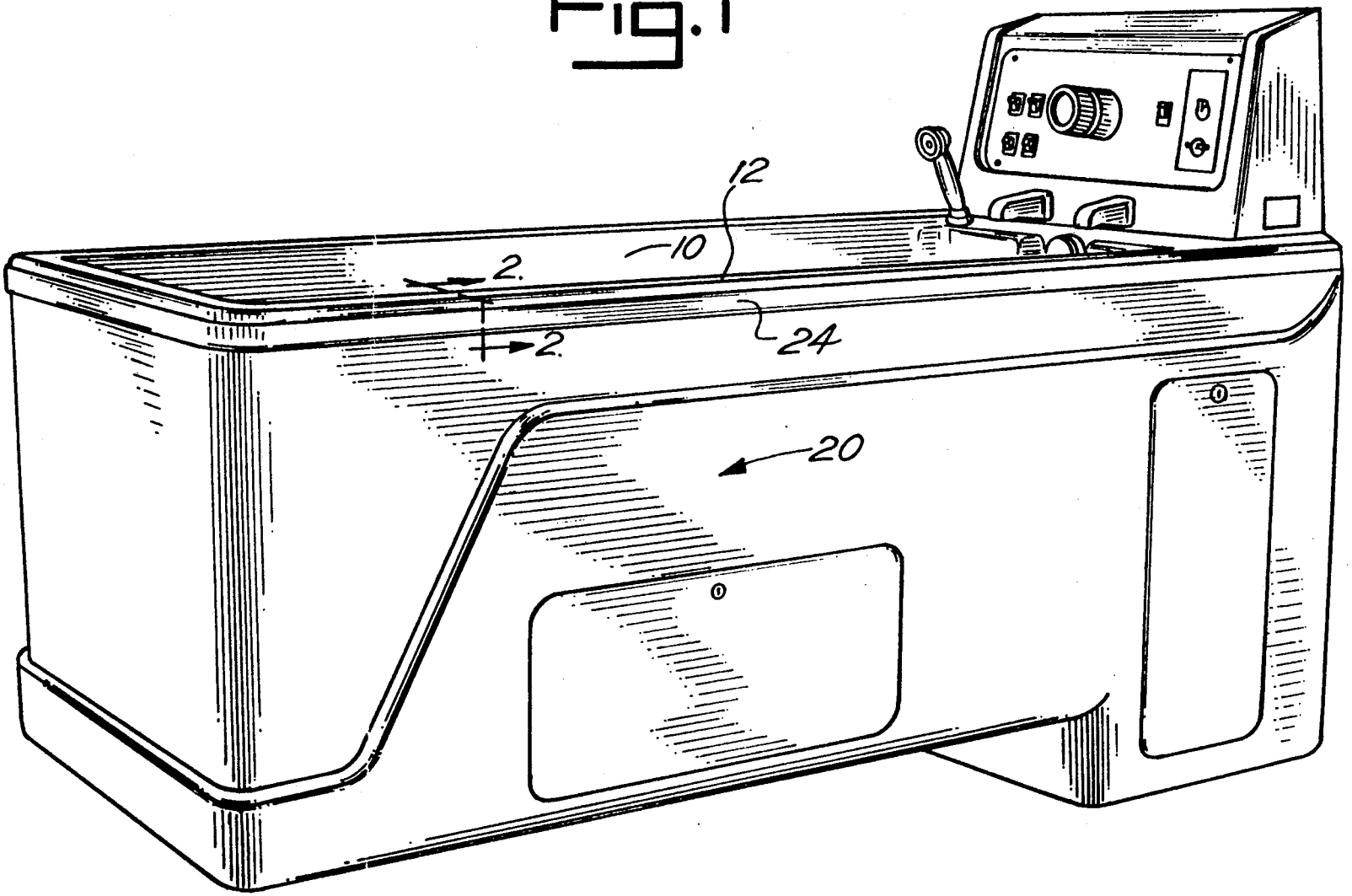
FIG. 1 is a perspective view of a total tub construction utilizing the present invention.
Figure 2:
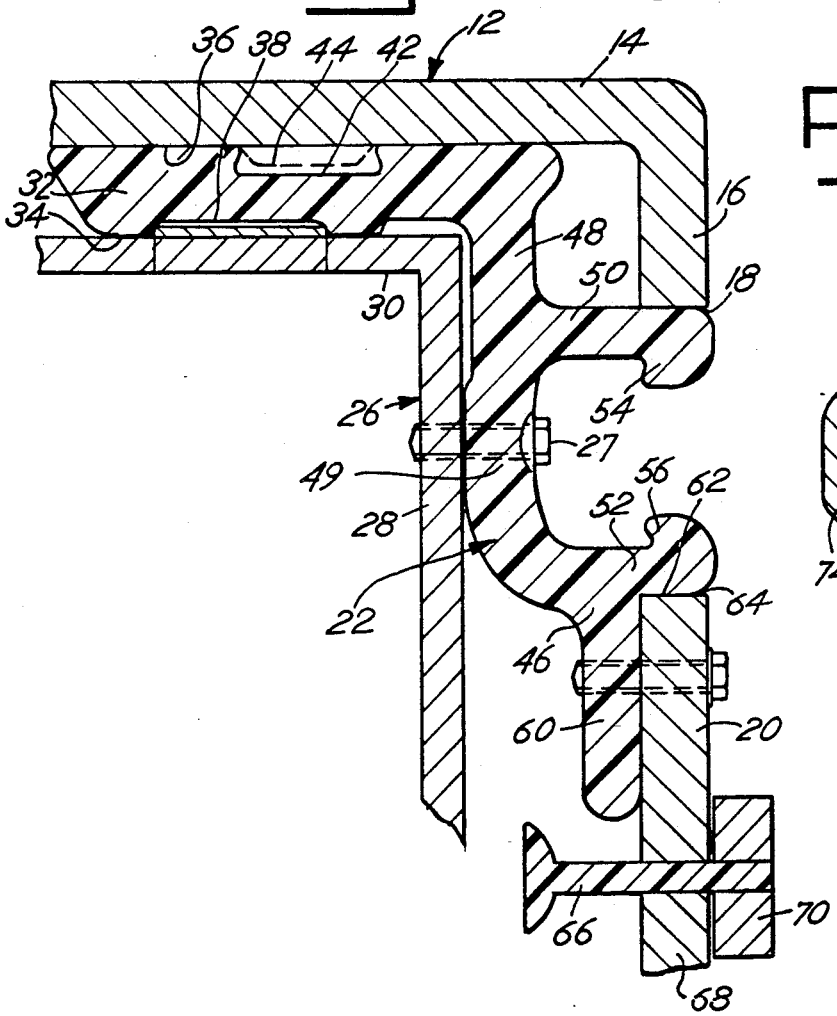
FIG. 2 is a cross sectional view of an edge of the tub construction taken substantially along the line 2—2 in FIG. 1.

Referring to FIG. 1, there is illustrated a typical tub construction which incorporates the subject matter of the present invention. The tub construction is comprised of an internal support frame (not shown in FIG. 1). Mounted on this internal support frame is a molded tub enclosure 10 which, for example, is shaped molded fiberglass defining a tub and further including a periphery 12 with a horizontal run 14 as shown in FIG. 2, a smoothly connected and depending run 16 and a lower peripheral edge surface 18. A vertical side wall panel 20 defines the outer surface of the side of the tub construction. The vertical side wall panel 20 is retained as will be described hereinafter. As shown in FIG. 2, a rigid tub assembly member 22, which is covered by a flexible trim member 24 as described in greater detail below, is mounted on frame 26 between the vertical sidewall panel 20 and the molded tube enclosure 10.

Referring therefor to FIG. 2, which is a section of a side of the tub construction, the periphery 12 of the molded tub enclosure is shown cooperative with the specially constructed rigid tub assembly member 22. Thus, a frame 26, defined by vertical frame members 28 and horizontal frame members 30, is retained within the interior of the tub construction. The rigid tub assembly member 22 cooperates with the frame 26 and in particular with the horizontal frame member 30. The rigid tub assembly member 22 further directly supports the molded tub enclosure 12 and also supports the vertical panels 20.

The rigid tub assembly member 22 thus includes a first horizontal section 32 which includes a lower surface 34 and an upper surface 36. A recess 38 is defined in the lower surface, and provides for the receipt of and works in cooperation with a block 40 attached to the frame member 30. The member 22 is retained in a relatively fixed position on the frame 26 by screws or fasteners 27 attached through a crown 49 (described below) in member 22. Adhesive material may be also utilized to affix the member 22 to the frame 26. The upper surface 36 also includes a recess 42. Adhesive material may be placed in the channel defined by the recess 42 for attachment of the tub enclosure 12 thereto. Alternatively, tabs or projections 44 may fit within the recess 42. The tabs 44 (shown in phantom lines), are integrally molded into the tub enclosure 12.

The tub enclosure 12 is typically molded, for example, from a fiberglass material. The molded construction permits a smoothly radius peripheral edge which connects with a downwardly extending vertical run 16 and defines a lower peripheral edge 18.

Figure 3:
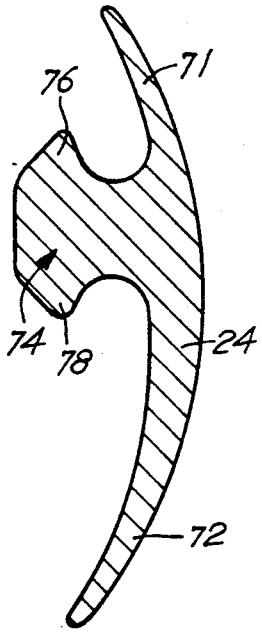
FIG. 3 is a cross sectional view of the flexible trim member which is used in the combination comprising the tub construction of the invention.

The member 22 further includes a downwardly depending vertical section 46. The downwardly depending vertical section 46 includes a first vertical run 48 which extends parallel to the wall 16. Next is defined a horizontally extending, U-shaped slot or channel comprising a first generally horizontal leg 50 and a lower horizontal leg 52 which are generally parallel to one another and spaced from one another. The crown 49 of the U-shaped legs 50 and 52 is comprised of an extension of the run 48. The legs 50 and 52 terminate with flanges 54 and 56 which cooperate with the molded flexible trim member 24 as shown in FIG. 3. A further downwardly depending run 60 defines the lower portion of the vertical panel support section 48. The run 60 is inwardly off set from the outer edge of the leg 52 to define a land 62 which provides a seam 64 against which the panel 20 is abutted. The vertical panel 20 thus defines, in essence, a smooth surface and a continuous surface from the peripheral edge 16 down through the surface of the panel 20. The edge 18 is separated from the seam 64 by the legs 50 and 52.

A quarter turn fastener 66 is inserted through an opening 68 defined in the vertical panel 20. By turning the fastener 66, and more particularly the head 70 of the fastener 66, it is possible to firmly support the panel 20 immediately adjacent the depending section or leg 60.

In FIG. 3 A molded, flexible trim member 24, made from an elastomeric material, includes an upwardly extending arm 71 and a downwardly extending arm 72. Member 24 also includes an inwardly extending rib member 74 with an upwardly projecting ridge 76 and a downwardly projecting ridge 78 as depicted in cross section in FIG. 3. This rib member 74 fits between the U-shaped legs 50 and 52 which are depicted in FIG. 2. More particularly, the rib member 74 fits within the cavity defined between the legs 50 and 52. The ridge 76 then is retained by the flange 54. The ridge 78 is retained by the flange 56. The arm or downwardly depending leg 72 fits over the seam 64 and also may cover screws or fasteners associated with panel 20. The upper arm 71 fits over the lower edge 18 of the tub enclosure 12 thereby covering another seam associated with the assembly.

As can be seen in reference to FIG. 1, when a frame 26 is utilized, the vertical panels 20 of the assembly can be easily disassembled by removal of the flexible trim member 24 and then removal of the panel 20 by operation of the quarter turn fasteners 66. In this manner, easy access to the interior of the tub construction within the frame can be obtained. Consequently, when the construction is assembled it is not only aesthetically pleasing, but also sharp edges and seams are sealed or covered thereby enhancing safety. It is possible to alter the described construction while practicing the subject matter of the invention. For example, the frame 26 could be eliminated and the assembly would then be comprised of a tub enclosure 10 joined to a circumferential wall panel 20 by means of assembly member 22 which is fastened to both. Flexible trim member 24 would still be used as described. The invention is therefor to be limited only by the following claims and their equivalents.

What is claimed is:

1. An improved bathing tub construction comprising, in combination:

a support frame;

a rigid molded tub enclosure defined by a shaped wall and having a periphery with a horizontal run, a partially depending vertical run smoothly connected to the periphery and an edge surface defining the lower external rim of the periphery;

at least one rigid vertical panel for enclosing a side of the frame;

a rigid tub assembly member supported on the frame and configured to receive and support the tub enclosure at the periphery of said enclosure to define a first seam, said assembly member further including a vertical panel support section for support of the vertical panel and thereby defining a second seam, and an elongated outside channel intermediate the seams; and a flexible trim member insertable in the outside channel to cover, seal and provide a generally flush surface for the channel over the seams between the assembly member, vertical panel and tub enclosure;

said rigid tub assembly member including a first horizontal section having an upper surface and a lower surface, the lower surface positioned on the frame, said upper surface for engaging the horizontal run of the tub enclosure;

said rigid tub assembly member further including a generally vertical panel support section with the elongated outside channel defined between the sections, said outside channel being generally U-shaped in cross section and defined by an upper leg and a spaced lower leg, the outside surface of the upper leg cooperative with the edge surface of the tub enclosure to define the first seam, the outside surface of the lower leg cooperative with the vertical panel to define the second seam, said seams and legs defining a generally vertical, planar outside surface and the trim member being cooperatively engaged between the legs and fitting over both the first and second seams to further define a generally planar, vertical outside surface.

2. The combination of claim 1 including fastener means through the vertical panel for engaging the vertical depending section of the rigid tub assembly member and for holding the vertical panel in position.

* * * * *